US008434233B2

(12) United States Patent
Okabe

(10) Patent No.: US 8,434,233 B2
(45) Date of Patent: May 7, 2013

(54) INNER CUTTER FOR A ROTARY SHAVER AND A ROTARY SHAVER USING THE SAME

(75) Inventor: Masaki Okabe, Matsumoto (JP)

(73) Assignee: Izumi Products Company, Nagano (JP)

( * ) Notice: Subject to any disclaimer, the term of this patent is extended or adjusted under 35 U.S.C. 154(b) by 220 days.

(21) Appl. No.: 11/890,423

(22) Filed: Aug. 6, 2007

(65) Prior Publication Data

US 2008/0028618 A1 Feb. 7, 2008

(30) Foreign Application Priority Data

Aug. 4, 2006 (JP) ..... 2006-213877

(51) Int. Cl.
*B26B 19/14* (2006.01)

(52) U.S. Cl.
USPC ..... 30/43.6; 30/43.5; 30/346.51

(58) Field of Classification Search ..... 30/43.4–43.6, 30/346.5, 43, 5, 6, 346.51; D28/44, 50; 76/115
See application file for complete search history.

(56) References Cited

U.S. PATENT DOCUMENTS

| | | | | | |
|---|---|---|---|---|---|
| 2,824,367 | A | * | 2/1958 | McWilliams | 30/41.5 |
| 3,125,808 | A | * | 3/1964 | Starre | 30/43.6 |
| 3,710,442 | A | * | 1/1973 | Meyer | 30/43.6 |
| 4,192,065 | A | * | 3/1980 | Tietjens | 30/43.6 |
| 4,222,168 | A | * | 9/1980 | Boiten et al. | 30/43.6 |
| 4,227,301 | A | * | 10/1980 | Van Hemmen et al. | 30/43.6 |
| 4,240,199 | A | * | 12/1980 | Boiten et al. | 30/43.6 |
| 4,262,416 | A | * | 4/1981 | Van Hemmen et al. | 30/43.6 |
| 4,729,169 | A | * | 3/1988 | Asawa | 30/346.51 |
| 4,882,840 | A | * | 11/1989 | Tietjens | 30/43.6 |
| D355,276 | S | * | 2/1995 | Uchiyama et al. | D28/50 |
| 5,390,416 | A | * | 2/1995 | Uchiyama et al. | 30/43.6 |
| 5,408,749 | A | * | 4/1995 | Momose | 30/43.6 |
| D365,420 | S | * | 12/1995 | Momose | D28/50 |
| 6,502,309 | B2 | * | 1/2003 | De Vries et al. | 30/34.2 |
| 6,581,289 | B2 | * | 6/2003 | Nakano | 30/43.6 |
| 7,178,242 | B2 | * | 2/2007 | Okabe | 30/43.6 |
| 7,665,214 | B2 | * | 2/2010 | Okabe | 30/43.4 |
| 8,191,264 | B2 | * | 6/2012 | Veenstra et al. | 30/43.6 |
| 2002/0014011 | A1 | * | 2/2002 | De Vries et al. | 30/43.6 |
| 2005/0120567 | A1 | * | 6/2005 | Okabe | 30/346.51 |
| 2008/0172881 | A1 | * | 7/2008 | Okabe | 30/43.6 |
| 2009/0025228 | A1 | * | 1/2009 | Minkes et al. | 30/43.6 |
| 2010/0095531 | A1 | * | 4/2010 | Akkerman et al. | 30/43.6 |

FOREIGN PATENT DOCUMENTS

| | | |
|---|---|---|
| DE | 1225991 | 9/1966 |
| EP | 0094128 | 11/1983 |
| EP | 1175972 | 1/2002 |
| JP | 2005-185827 | 7/2005 |
| WO | WO 2004/012914 | 2/2004 |

* cited by examiner

*Primary Examiner* — Hwei C Payer
(74) *Attorney, Agent, or Firm* — DLA Piper LLP (US)

(57) ABSTRACT

An inner cutter, which is used for a rotary shaver, including a plurality of blade supports formed so as to be raised from an inner cutter main body and provided with cutter blades formed, respectively, at the tip ends of the raised blade supports, with positions where the blade supports are raised being located more forward in the direction of rotation of the inner cutter than the leading edge positions of the cutter blades.

5 Claims, 9 Drawing Sheets

| SAMPLES | A | B | C | D | E | F |
|---|---|---|---|---|---|---|
| 100 HOURS / 50 HOURS / 0 | PASS (OK) LINE; ave=20.2 | ave=6.3 | | ave=5.8 | | |
| INNER CUTTER MATERIAL THICKNESS | 0.5mm | 0.3mm | 0.5mm | 0.3mm | 0.5mm | 0.3mm |
| JUDGMENT | NG | NG | OK | NG | OK | OK |

INNER CUTTER FOR A ROTARY SHAVER AND A ROTARY SHAVER USING THE SAME

BACKGROUND OF THE INVENTION

1. Field of the Invention

The present invention relates to an inner cutter for a rotary shaver and to a rotary shaver that uses the same and more particularly to an inner cutter for a rotary shaver in which the material thereof can be made thin and which exhibits outstanding anti-wear properties and to a rotary shaver using such an inner cutter.

2. Description of the Related Art

In electric shavers, such as rotary shavers, the relationship between the anti-wear properties (feel of the shave) and the designing of the material to be thin is generally a relationship of a trade-off to take only one of the two. In other words, when priority is given to anti-wear properties, it becomes very difficult to make the material thinner and inner cutter manufacturing costs go up, whereas, when designing the material thinner is given priority, then it becomes difficult to realize anti-wear properties and product value declines. Accordingly, in general, for inner cutters and rotary shavers placed on the market, a balance is maintained between anti-wear properties and designing of the material to be thinner in inner cutters.

In order to effect good shaves with an inner cutter for a rotary shaver in which such a balance is taken between anti-wear properties and designing of the material to be thinner, cutter blades of inner cutter are usually inclined in the direction in which the inner cutter rotates as shown in, for instance, FIG. 6 of Japanese Patent Application Laid-Open (Kokai) No. 2005-185827. The reason for the inclined cutter blades is that, by taking the shape like that of FIG. 6 in Japanese Patent Application Laid-Open (Kokai) No. 2005-185827, it becomes possible to effect good shaves even with a thin-material structure.

Here, the structure in which the cutter blades of the inner cutter in a rotary shaver are inclined in the direction of rotation of the inner cutter means that the position of the leading tip end portions (or leading edge portions) of the cutter blades of the inner cutter are located forward, relative to the base portions thereof, in the direction of rotation of the inner cutter.

When the inner cutter for a rotary shaver is thin, such a measure is sometimes implemented that an inner cutter guide vibration-preventing member which is for supporting the lower surface of the inner cutter main body is provided in an inner cutter guide that connects the inner cutter to the output shaft of a drive means provided in the rotary shaver, so that, the lower surface of the inner cutter main body is supported thereby, and thus preventing vibration when the inner cutter is rotated.

However, when the inner cutter for a rotary shaver such as that shown in Japanese Patent Application Laid-Open (Kokai) No. 2005-185827 is rotated, minute vibrations tend to occur in the cutter blade supports (the elements 118 in Japanese Patent Application Laid-Open (Kokai) No. 2005-185827) of the inner cutter due both to friction caused by the blade surface sliding resistance between the outer cutter and the inner cutter and to shaving resistance. As a consequence, there are such problems that abnormal wear occurs in the portions of the blade surfaces of the outer cutter and inner cutter that slide against each other and that the feel of the shave deteriorates. In some cases, moreover, the rotary shaver is damaged and not usable any longer.

In the following, minute vibrations that would occur in the inner cutter (or inside the cutter blades of inner cutter) will be described. FIG. 15 shows illustrations that represent a blackboard and a piece of chalk when a line is being drawn on the blackboard with the chalk.

As shown in Illustration A of FIG. 15, when the chalk is slanted toward the blackboard, and the chalk is moved in the direction of the arrow while lightly pressing the chalk against the blackboard (advancing in a direction from the end of the chalk being held by hand toward the end of the chalk that is in contact with the blackboard), stuttering occurs due to the relationship between the force of friction, which is between the blackboard and the chalk, and the force with which the chalk is being pressed. As a result, an intermittent movement phenomenon would occur so that the chalk skips over the blackboard (such phenomenon will be called "chalk phenomenon") as shown in Illustration B of FIG. 15.

When the force that the chalk is pressed against the blackboard and the speed of movement of the chalk is held constant, then the way the chalk phenomenon occurs will be different depending on the angle of inclination $\alpha$ of the chalk to the blackboard. In other words, when the angle of inclination $\alpha$ of the chalk relative to the blackboard is small as shown in Illustration C of FIG. 15, the chalk phenomenon will not readily occur. When, on the other hand, the angle of inclination $\alpha$ of the chalk relative to the blackboard is great as shown in Illustrations D and E of FIG. 15, the chalk phenomenon will readily occur. When, however, as shown in Illustration F of FIG. 15, the chalk being pressed against the blackboard is moved in a direction opposite the direction of chalk movement as shown in Illustration F of FIG. 15, even when the angle of inclination of the chalk relative to the blackboard is about the same as this angle of inclination in Illustration F of FIG. 15, the chalk phenomenon will not occur.

This so-called "chalk phenomenon" described above is not a phenomenon that occurs only between a blackboard and a piece of chalk, but it would occur similarly in metals, plastics, and wood materials and the like. Furthermore, as shown in Illustration G of FIG. 15, the greater the length of the moving body, and the greater ease wherewith deflection occurs in the moving body, the greater the tendency would be for the chalk phenomenon to occur in a pronounced way.

Also, in electric shavers, because such measures as attaching inner cutter guide vibration-preventing members as described earlier, or designing the inner cutter sheet thickness thicker are implemented as general techniques for extending the useful life of inner cutters, there is a problem of soaring inner cutter manufacturing costs.

Furthermore, in response to the demand for cleanliness, most electric shavers, including rotary shavers, in recent years, are products that can be washed in water. In almost all of these electric shavers that can be washed in water, the cutters are moved (rotated, or reciprocated in reciprocating shavers) in an unoiled condition after washing. When the cutters are, for instance, rotated in such an unoiled condition, additional loads are placed on the inner cutter and outer cutter, causing a problem that wear between the inner cutter and outer cutter is accelerated. Because inner cutters and outer cutters are used in such severe conditions, it may now be said that hair cutting sharpness deteriorates in a shorter time than with conventional rotary shavers.

SUMMARY OF THE INVENTION

An object of the present invention is to provide an inner cutter for a rotary shaver and a rotary shaver that uses the same, wherein, by preventing the chalk phenomenon caused between the inner cutter and outer cutter, the deployment of parts which is for suppressing (minute) vibrations in the inner cutter is made unnecessary, abnormal wear in the inner and outer cutters is prevented by maintaining the sliding condition between the inner cutter and the outer cutter in a suitable condition, and cutting sharpness is well maintained for a long time even with a thin-material structure in the inner cutter.

The above object is accomplished by a unique structure of the present invention for an inner cutter for a rotary shaver wherein the inner cutter is comprised of a plurality of blade supports formed so as to be raised from an inner cutter main body, and cutter blades provided, respectively, at the tip ends of the blade supports, and in this inner cutter, the positions where the blade supports are raised are located more forward in the direction of rotation of the inner cutter than the positions of the leading blade-tip of the cutter blades.

In the above-described inner cutter of the present invention, at least one bent portion or curved portion is formed in each one of the blade supports.

In addition, the above-described cutter blades are provided at the tip ends of the blade supports without changing the linear form (or the curvature) in the tip ends of the blade supports.

Furthermore, in the present invention, the blade supports are inclined backward in the direction of the rotation of the inner cutter.

As a consequence of these characteristics, the height position of the cutter blades, when the inner cutter is rotated, can be lower than the height position of the cutter blades prior to rotating the inner cutter; and a result, it is possible to prevent the occurrence of the chalk phenomenon that would occur by the cutter blades and the outer cutter. Accordingly, in the inner cutter of the present invention, the condition in which the cutter blades and the outer cutter slide against each other is maintained in a suitable condition, and, abnormal wear in the cutter blades and outer cutter can be prevented.

The above object is further accomplished by a unique structure of the present invention for a rotary shaver that includes a shaver frame body, a power supply unit and an inner cutter drive unit both provided in the shaver frame body, an inner cutter(s) that is(are) rotationally driven in linkage with the inner cutter drive unit, and an outer cutter(s) for shaving hair in cooperation with the (rotating) inner cutter(s), and in this shaver, the inner cutter(s) is(are) comprised of a plurality of blade supports formed so as to be raised from an inner cutter main body(s), and cutter blades provided, respectively, at the tip ends of the blade supports; and in this structure, the positions where the blade supports are raised are located more forward in the direction of rotation of the inner cutter(s) than the positions of the leading blade-tip of the cutter blades.

In this rotary shaver, at least one bent portion or curved portion is formed in each one of the blade supports of the inner cutter(s). In addition, the cutter blades are provided at the tip ends of the blade supports without changing the linear form (or the curvature) in the tip ends of the blade supports. Furthermore, the blade supports are inclined backward in the direction of the rotation of the inner cutter(s).

According to the inner cutter for a rotary shaver of the present invention, the blade supports exhibit deflection oriented backward in the direction of the rotation of the inner cutter when the cutter blades are subjected to a sliding resistance with the outer cutter, or when a load is sustained during shaving. Due to such deflection, the cutter blades of the inner cutter will pull away from the blade surfaces of the outer cutter, so that the chalk phenomenon is avoided, and abnormal wear in the cutter blades and outer cutter is prevented.

As a consequence, the hair cutting sharpness of the rotary shaver is maintained for a long period of time even when the shaver that uses the inner cutter(s) is used in the unoiled condition after washing.

Also, because a suitable sliding condition between the outer cutter and the cutter blades of the inner cutter is maintained, measures to prevent the chalk phenomenon between the cutter blades and the outer cutter is unnecessary, and it is possible to adopt a thin-material structure. If the inner cutter is given a thin-material structure in this manner, the inner cutter manufacturing cost can be reduced.

By implementing what has been described above, a long-lived rotary shaver is provided at low cost.

DETAILED DESCRIPTION OF THE INVENTION

Figure 1:
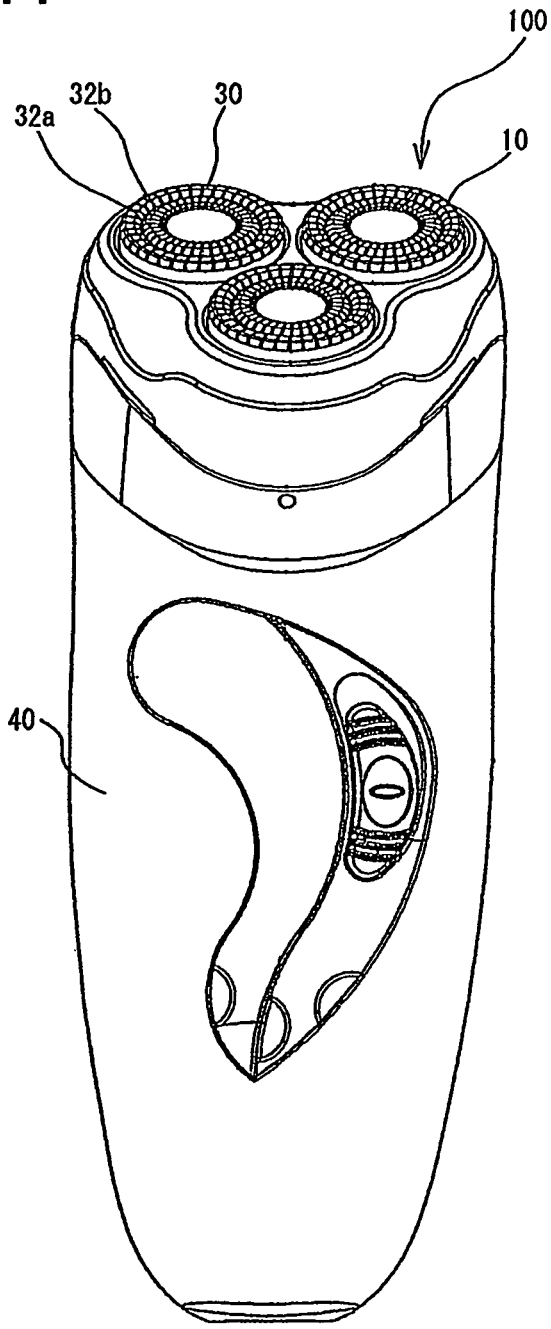
FIG. 1 is an external view of a rotary shaver according to one embodiment of the present invention.
Figure 2:
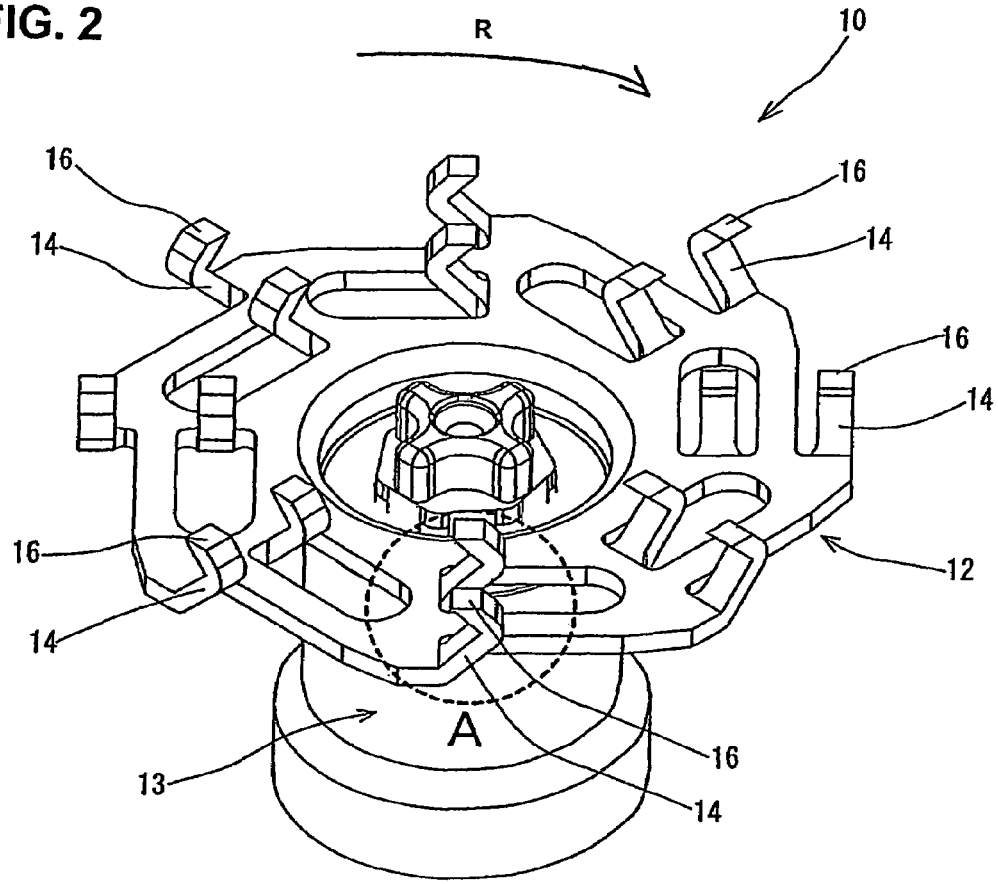
FIG. 2 is a perspective view of an inner cutter for a rotary shaver according to one embodiment of the present invention.
Figure 3:
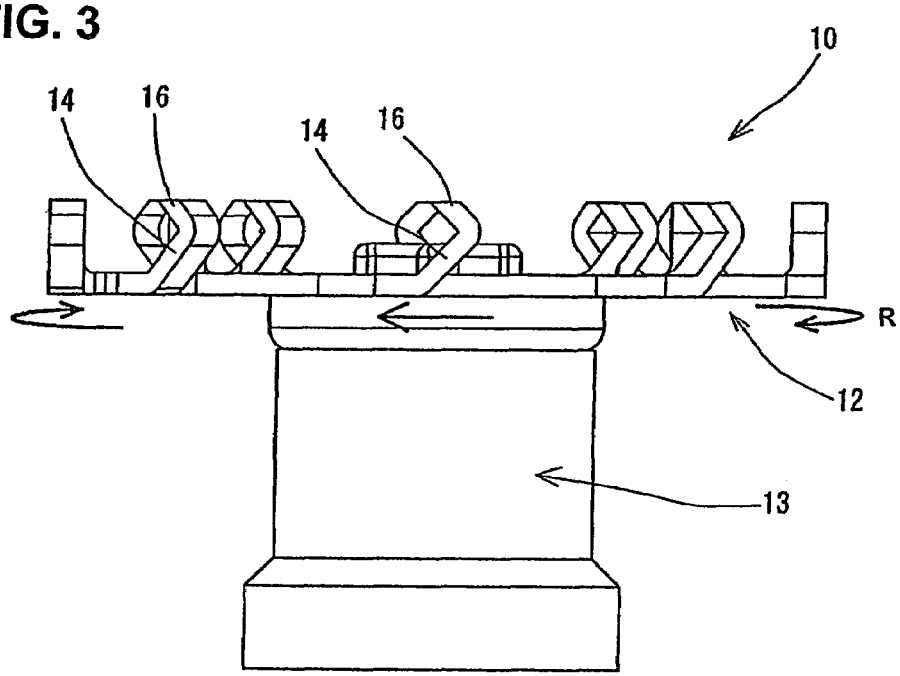
FIG. 3 is a front elevational view thereof.
Figures 4, 5:
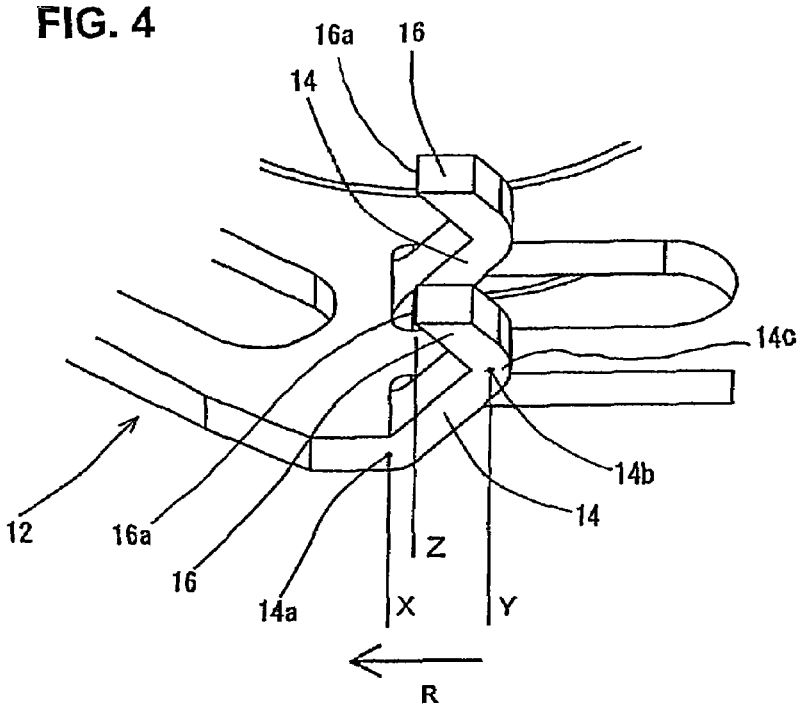
FIG. 4 is an enlarged explanatory diagram of Portion A in FIG. 2.
FIG. 5 is a graph showing the results of durability tests on the inner cutter for a rotary shaver according to the embodiment of the present invention and on the conventional inner cutters for rotary shavers.

Embodiments of the present invention will be described with reference to the accompanying drawings. FIG. 1 shows a rotary shaver according to the embodiments of the present invention. FIG. 2 is a perspective view of the inner cutter for a rotary shaver of one embodiment. FIG. 3 is a front view thereof. FIG. 4 is an enlarged explanatory diagram of Portion A in FIG. 2.

As seen from FIG. 1, the rotary shaver 100 is an electrically chargeable type shaver that includes a chargeable battery which is a power supply (power source) and a motor which is a drive unit housed inside the frame body 40 of the shaver (and thus neither the chargeable battery or the motor are shown in FIG. 1). At the top of the shaver frame body 40, three inner cutters 10 (see FIGS. 2 to 4), which are rotationally driven in linkage with the output shaft (not shown) of the motor, and three outer cutters 30, which are for cutting hair in conjunction with the inner cutters 10, are provided such that they, respectively, are detachable with respect to the shaver frame body 40. In the shown embodiment, three pairs of outer and inner cutters are provided in the shaver 100 (or in the shaver frame body 40) so as to be arranged in a triangular shape; and the present invention is applicable to rotary shavers with different number(s) of outer and inner cutters than the shown embodiment.

The inner cutter 10 for the rotary shaver 10 (hereinafter sometimes referred to simply as the "inner cutter 10") shown in FIGS. 2 to 4 is formed of thin stainless steel sheet. The inner cutter 10 is comprised of an inner cutter main body 12 having underneath an inner cutter guide 13 which is connected to the output shaft of the drive unit housed in the shaver frame body of the rotary shaver 100, a plurality of blade supports 14 raised from the inner cutter main body 12, and a cutter blade 16 formed at the tip end portion (or the upper end portion in the drawings) of each one of the blade supports 14.

The cutter blades 16 in this embodiment are provided in two rows, on the inner circumference side and on the outer circumferential side, in the radial direction of the inner cutter main body 12. The cutter blades 16 slide, with a prescribed frictional force, against inner surface of the outer cutter 30, in inner circumferential side slits 32*a* and outer circumferential side slit 32*b* in each one of the outer cutters 30, which are shown in FIG. 1. Hair entered through the slits 32*a* and 32*b* into the interior of the outer cutter 30 is cut by the cutter blades 16 (of the rotating inner cutter 10) that slide over the inner surfaces of the portions between the slits 32*a* and 32*b*.

The blade supports 14 are formed at equal intervals in the direction of rotation of the inner cutter 10 in the inner cutter main body 12. The blade supports 14 are formed by being cut from the inner cutter main body 12. The blade supports 14, after being cut from the inner cutter main body 12, are bent and raised on the inner cutter main body 12 so as to be inclined in a direction opposite from the direction of rotation of the inner cutter 10 (the rotational direction of the inner cutter 10 is shown by arrow R in FIG. 4).

As shown in FIG. 4, the cutter blades 16 are formed, as described above, at the tip end portions 14*b* of the blade supports 14. The cutter blades 16 are formed so as to be inclined in a direction opposite from the direction of inclination of the blade supports 14. In other words, the cutter blades 16 are formed so that they are, from the points of the tip end portions 14*b* of the blade supports 14, inclined forward in the direction of rotation of the inner cutter 10 shown by arrows R in FIG. 3. More specifically, the blade supports 14 are raised so as to incline in the direction opposite from the rotational direction R of the inner cutter 10, and the cutter blades 16 are formed on the blade supports so as to be inclined into the rotational direction R of the inner cutter 10.

In this structure, the blade supports 14 and the cutter blades 16 are formed so as to take a substantially inverted L shape (or in a ">" shape as seen from drawings). Causing the cutter blades 16 to be inclined in the direction of rotation of the inner cutter 10 in this manner allows the feel of the shave to be enhanced, even with a thin-material structure (or even if the inner cutter main body 12, the blade supports 14, and the cutter blades 16 are made of a thin metal material of, for instance, 0.3 mm), and thus it is advantageous. The blade supports 14 and the cutter blades 16 in the shown embodiment are formed integrally, and they can be formed by press machining.

Furthermore, as seen from FIG. 4, the position X of each one of the raised portions 14*a* of each one of the blade supports 14 that is the portion of the blade support 14 raised up from the inner cutter main body 12 is set to be located forward in the direction of rotation of the inner cutter 10 relative to the position Y of the reverse bent portion 14*c* which is substantially inverted L shape formed by the cutter blade 16 and (the tip end portion 14*b* of) the blade support 14. Furthermore, the position X of each one of the raised portions 14*a* is set to be located forward in the direction of rotation of the inner cutter 10 relative to a position Z where the leading tip end (blade tip end or blade's forward edge) 16*a* of the cutter blade 16 is located. In other words, the leading edge 16*a* of each cutter blade 16 is behind the raised portion 14*a* of the blade support with reference to the rotational direction R of the inner cutter 10.

By providing each of the raised portions 14*a*, support tip end portions 14*b*, bent portions 14*c*, and leading tip ends (blade tip end or blade's forward edge) 16*a* so that their positional relationships are as described above, an action in which the cutter blades 16 pull away from the outer cutter when the inner cutter 10 is rotated occurs; and as a result, abnormal sliding between the cutter blades 16 and the outer cutter is prevented assuredly. Accordingly, anything that would adversely affect the feel of the shave, such as wear in the cutter blades 16 and outer cutter 30 and/or blade breakage is prevented.

FIG. 5 is a graph representing the results of durability tests on the inner cutter for a rotary shaver in the shown embodiment and inner cutter for rotary shavers of conventional art.

In conducting these durability tests, inner cutters and outer cutters, after being cleaned in a trichloroethylene ultrasonic cleaning machine, and after verification that they had been degreased, were connected to the output shaft (rotating shaft) of rotary shavers having a common configuration. In these durability tests, the inner cutters on rotary shavers are rotated for three minutes and then the rotation is stopped for three minutes, and this action was performed repeatedly. These on-off actions were repeated until the cumulative on time of the on-off actions reached 100 hours.

In the durability tests, when damage to an outer cutter (such as a crack developing in the outer cutter, and the outer cutter breakage) occurred, or when abnormal wear developed in the slide surfaces of the outer cutter and inner cutter, an NG (no good) judgment was made. When, on the other hand, a cumulative on time for the on-off action of 100 hours was reached without any damage occurring in the outer cutter or any abnormal wear occurring in the sliding surfaces of the outer cutter and inner cutter, an OK judgment was made. Outer cutter damage checks were performed every six minutes (after every on-off cycle) by microscopic examination at a magnification power of 20×.

Three of each sample were tested under the same conditions. In cases an NG judgment is made, the average value (in hours) of the cumulative time of three samples is taken and indicated by "ave" (average).

Figure 6A:
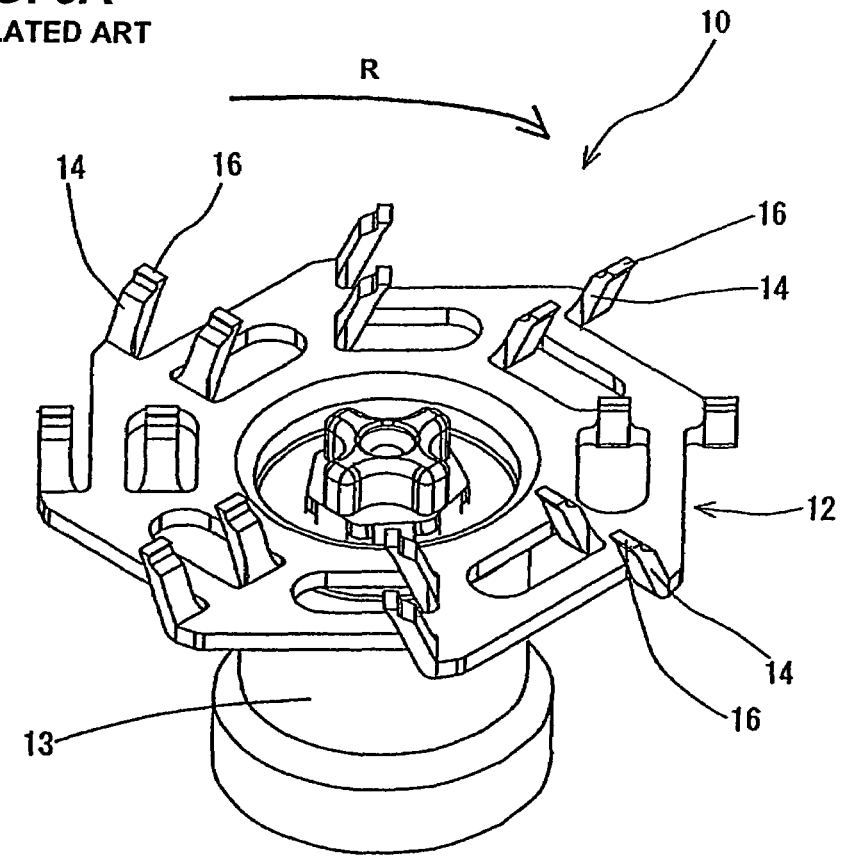
FIG. 6A RELATED ART
FIG. 6A is an explanatory diagram showing the shape of a conventional inner cutter of the samples A and B used in the durability tests, FIG. 6B being a front view thereof.
Figure 6B:
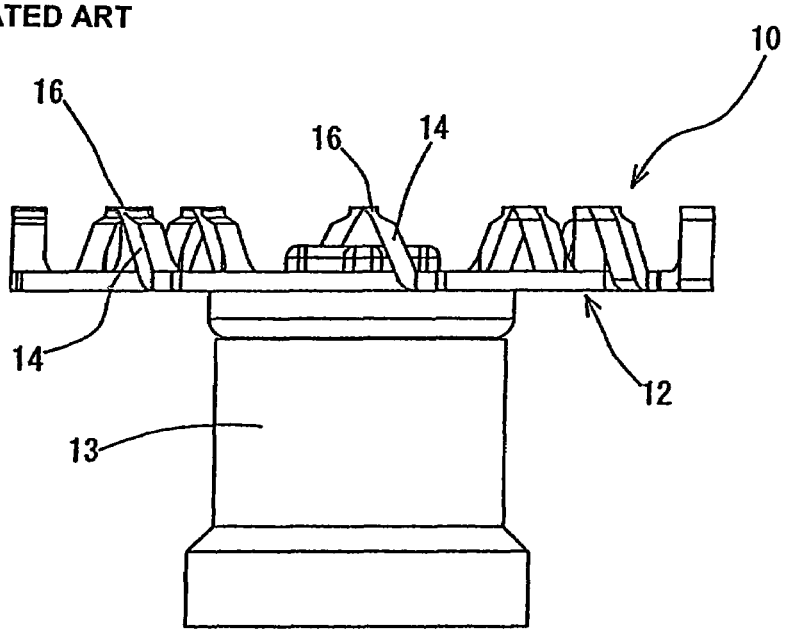
FIG. 6B RELATED ART

In the inner cutters in samples A and B in FIG. 5, the cutter blades 16 are formed at the tip ends of blade supports 14 that are, as shown in FIGS. 6A and 6B, raised from the inner cutter main body 12 so that the tip end portions of the blade supports 14 are inclined forward in the rotational direction R of the inner cutters. The blade supports 14 and the cutter blades 16 are, as seen from FIGS. 6A and 6B, formed in a straight line. The sheet thicknesses of the blade supports 14 in samples A and B are, respectively, 0.5 mm and 0.3 mm.

Sample A was given an NG judgment, with an average value of cumulative time being 20.2 hours. Sample B was also given an NG judgment, with an average value of cumulative time being 6.3 hours.

Figure 7A:
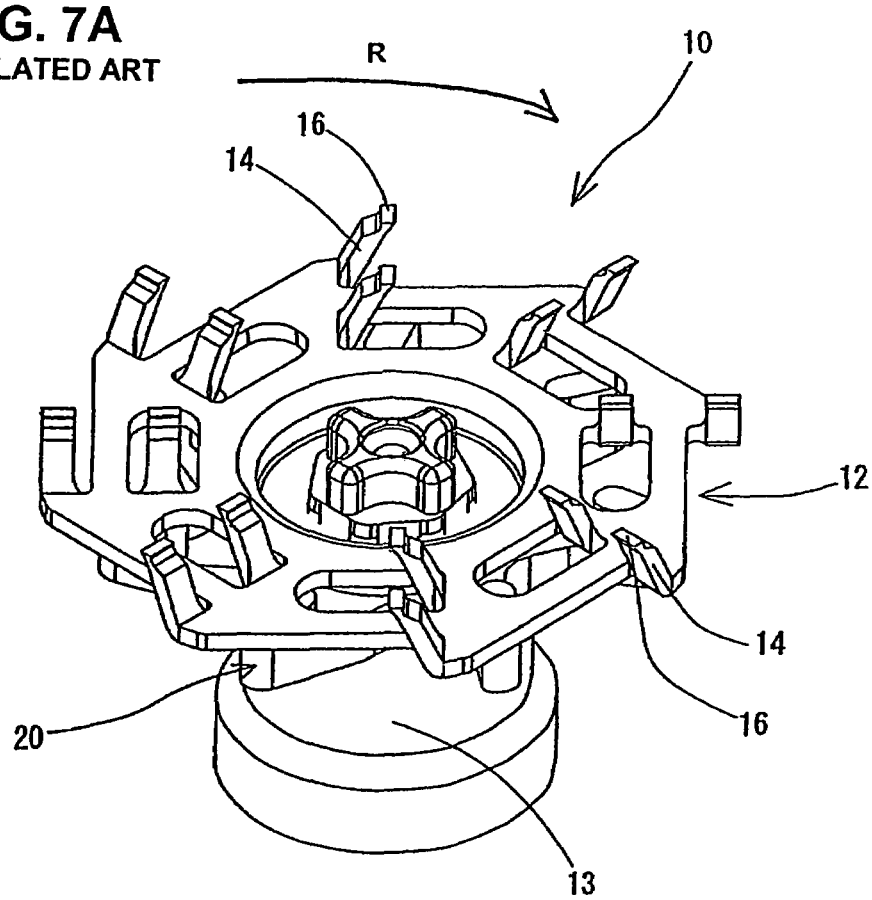
FIG. 7A RELATED ART
FIG. 7A is an explanatory diagram showing the shape of a conventional inner cutter in the samples C and D used in the durability tests, FIG. 7B being a front view thereof.
Figure 7B:
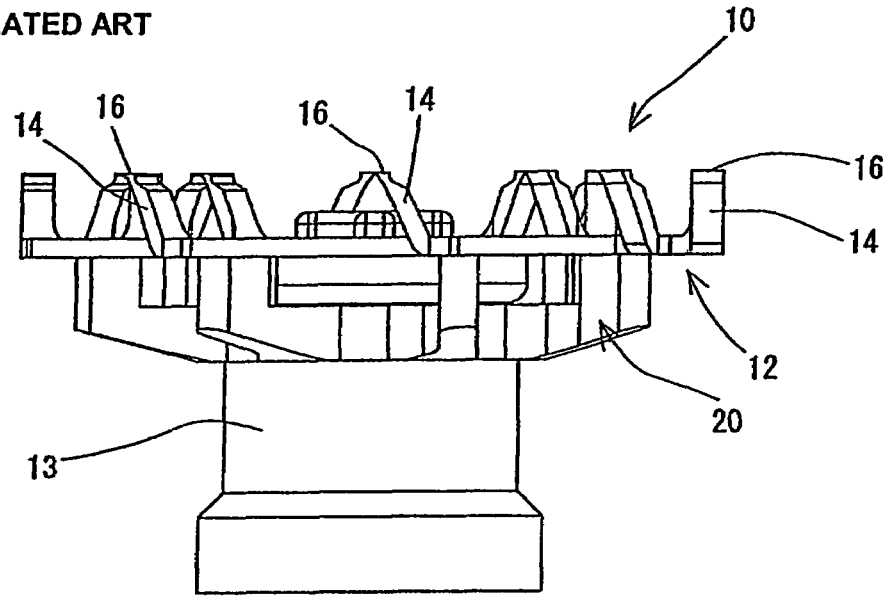
FIG. 7B RELATED ART

In the inner cutters in samples C and D in FIG. 5, the cutter blades 16 are, as shown in FIGS. 7A and 7B, formed at the tip ends of blade supports 14 raised from the inner cutter main body 12 so that the tip end portions are inclined forward in the rotational direction R of the inner cutters. In the inner cutters 10 of samples C and D also, the blade supports 14 and the cutter blades 16 are formed in a straight line. The sheet thicknesses of the blade supports 14 in samples C and D are, respectively, 0.5 mm and 0.3 mm. In the respective inner cutter guides 13 of the sample inner cutters C and D, inner cutter guide swing-prevention members 20 are provided for supporting the lower surface of the inner cutter main body 12.

Sample C was given an OK judgment. Sample D, however, was given an NG judgment, with an average value of cumulative time being 5.8 hours.

The differences between sample A and sample C, and, likewise, between sample B and sample D, are, in both cases, the difference of providing or not providing the inner cutter guide swing-preventing members 20. Looking at the results of the durability tests for sample A and sample C, it can be seen that providing the inner cutter guide swing-preventing members 20 is beneficial; however, looking at the results of the durability tests for sample B and sample D, there is no benefit in providing the inner cutter guide swing-preventing members 20.

As seen from the above, it is evident that, when the sheet thickness of the inner cutter 10 is thin, even when the inner cutter guide swing-preventing members 20 are provided for the inner cutters 10, minute vibrations in the inner cutters 10 are not avoidable.

The inner cutters 10 in samples E and F in FIG. 5 have the same shape as shown in FIG. 2 to 4 and described for the embodiment above. As seen from FIG. 5, the results of the durability tests were that OK judgments were given to both samples E and F.

As seen from the durability test results described above, it is clear that by adopting the inner cutter shape of the present invention, inner cutters have satisfactory durability, even when the sheet thickness of the blade supports 14 (that is, of the inner cutter main body 12 and cutter blades 16) is given a thin-material structure (having a 0.3 mm thickness). In addition, even without inner cutter guide swing-preventing members, the chalk phenomenon between the cutter blade 16 and the outer cutter is prevented, so that the quality of the inner cutter 10 is enhanced at low cost.

The inner cutter for a rotary shaver according to the present invention is not limited to or by the embodiment described above; and, needless to say, such inner cutters as those in which various modifications are made within the scope not altering the characteristics of the invention are within the technical scope of the present invention.

For example, in the shown embodiment, the inner cutter 10 (or the blade support 14 and cutter blade) is in an inverted L (or ">") shape as shown in, for instance, FIG. 2, but the inner cutter 10 of the present invention is not limited to or by this shape.

Figure 8:
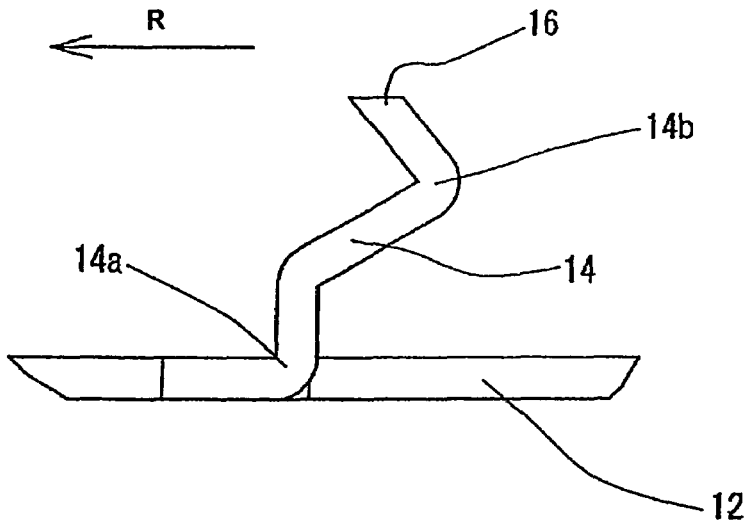
FIG. 8 is an explanatory diagram showing the shape of an inner cutter (blade support and cutter blade) of another embodiment of the present invention.

More specifically, the inner cutter 10 can be formed so that, as shown in FIG. 8, the blade support 14 is raised or erected perpendicular to the inner cutter main body 12 and bent in the direction opposite from the inner cutter rotating direction R, and then the blade tip end of the cutter blade 16 at the tip end portion 14*b* of the blade support 14 is oriented in the direction of rotation of the inner cutter 10.

Figure 9:
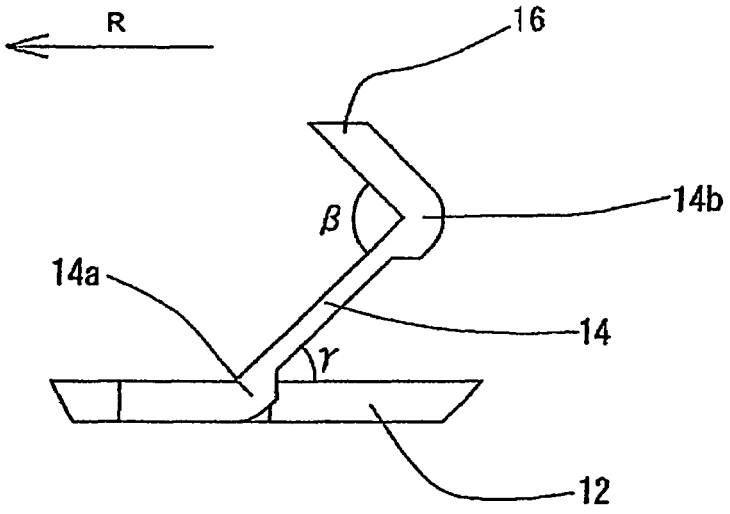
FIG. 9 is an explanatory diagram showing the shape of an inner cutter (blade support and cutter blade) of still another embodiment of the present invention.

It is also possible, as shown in FIG. 9, that the blade support 14 is raised from the inner cutter main body 12 and inclined backward in the rotational direction R of the inner cutter 10 (or inclined in the opposite direction to the rotational direction R of the inner cutter 10), and then the thickness of the material midway along the blade support 14 is made smaller by press machining or the like so as effect a mode in which the elasticity is adjusted. The blade tip of the cutter blade 16 at the tip end portion 14*b* of the blade support 14 is of course provided so that it is oriented in the direction of rotation of the inner cutter 10.

In this inner cutter shown in FIG. 9, the (size of the) angle β between the blade support 14 and the cutter blade 16 and the (size of the) angle γ between the blade support 14 and the inner cutter main body 12 are not particularly limited, and such angles can be freely set insofar as it lies within the range that satisfies the present invention.

Figure 10:
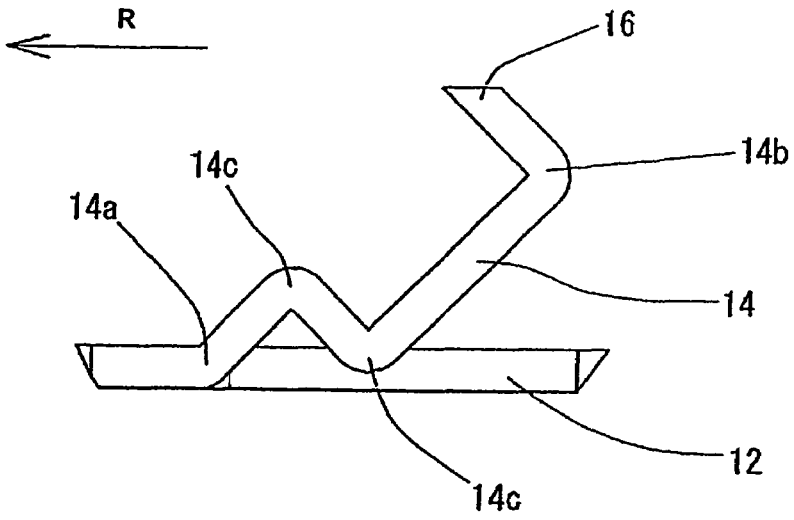
FIG. 10 is an explanatory diagram showing the shape of an inner cutter (blade support and cutter blade) of still another embodiment of the present invention.
Figure 11:
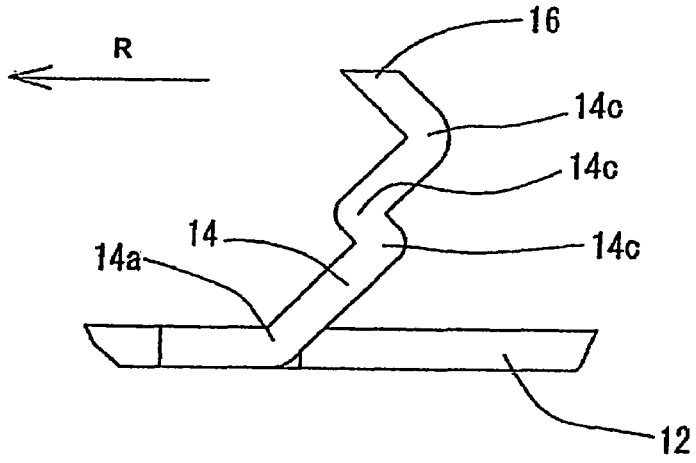
FIG. 11 is an explanatory diagram showing the shape of an inner cutter (blade support and cutter blade) of still another embodiment of the present invention.

Furthermore, in the present invention, it is also possible, as shown in FIG. 10 and FIG. 11, to provide bent portions 14*c* at a plurality of locations in each one of the blade supports 14 that are raised from the inner cutter main body 12 and inclined backward in the direction of rotation of the inner cutter (or in the direction opposite from the rotational direction R of the inner cutter). In these structures, the strength and elasticity of the blade supports 14 is adjusted to a desired condition.

Figure 12:
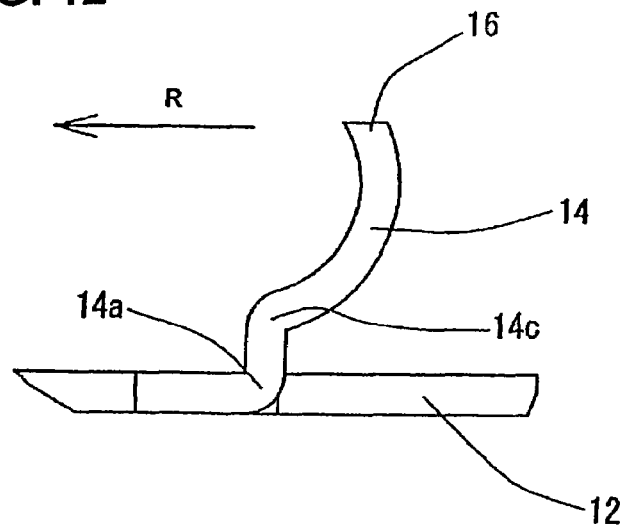
FIG. 12 is an explanatory diagram showing the shape of an inner cutter (blade support and cutter blade) of still another embodiment of the present invention.
Figure 13:
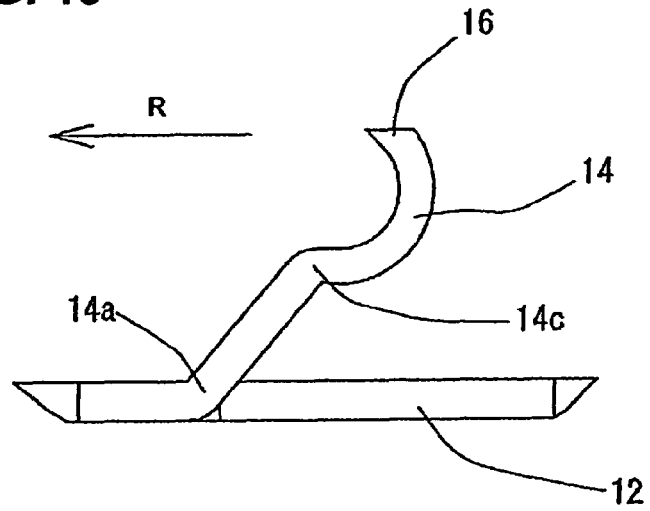
FIG. 13 is an explanatory diagram showing the shape of an inner cutter (blade support and cutter blade) of still another embodiment of the present invention.

Furthermore, as shown in each of FIGS. 12 and 13, the cutter blade 16 of the inner cutter can be formed in a circular arc shape at the tip end portion of the blade support 14 that is raised from the inner cutter main body 12. This is a mode in which the bent portion 14*c* is formed midway along the blade support 14 which is raised from the inner cutter main body 12, and then the portion between the bent portion 14*c* and the cutter blade 16 is formed in a circular arc to form a curved shape. In this inner cutter as well, needless to say, the tip end (blade tip portion) of the cutter blade 16 is oriented in the rotational direction R of the inner cutter 10. The blade support 14 raised from the inner cutter main body 12 needs only to be such that the blade support 14 is not inclined forward in the direction of rotation of the inner cutter 10 (or in the same direction as the inner cutter rotational direction R), and, needless to say, it is also possible to erect the blade support 14 perpendicularly from the inner cutter main body 12 and the curved blade support 14 is formed thereon as shown in FIG. 12.

Figure 14:
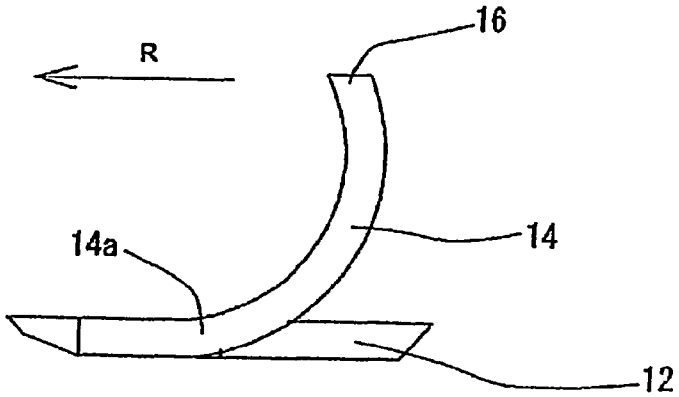
FIG. 14 is an explanatory diagram showing the shape of an inner cutter (blade support and cutter blade) of still another embodiment of the present invention.
Figure 15:
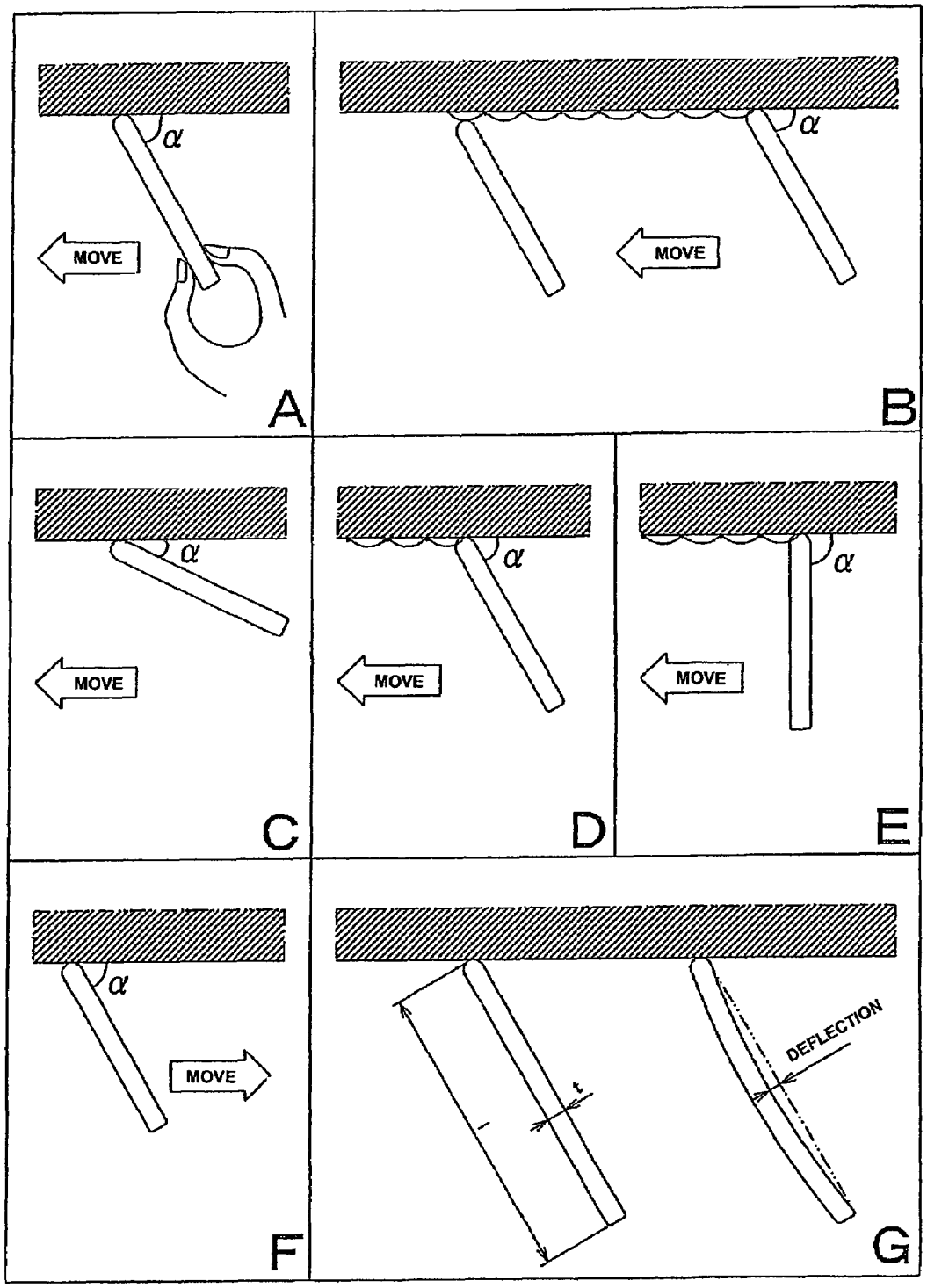
FIG. 15 RELATED ART
FIG. 15 is an explanatory diagram of the condition (relation) of a blackboard and a chalk when drawing a line on a blackboard with a chalk.

In the structure of FIG. 14, the entire shape of the blade support 14 is formed in a circular arc, and the cutter blade 16 is provided so as to coincide with the linearity or the curvature of the entire shape of the blade support 14, so that the blade support 14 and the cutter blade 16 assume the same circular arc or curved shape. In this curved blade support and cutter blade structure as well, needless to say, the position of the raised portion 14*a* of the blade support 14 is set at a position which is more forward in the rotational direction R of the inner cutter 10 than the position of the leading edge (blade tip end or blade's forward edge) of the cutter blade 16.

In the inner cutters 10 described above, the blade supports 14 are raised (or erected) in a plurality of rows in the radial direction in the inner cutter main body 12; however, it is not absolutely necessary that the number of raised portions (blades supports) on the outer circumferential side coincide with the number of raised portions (blades supports) on the inner circumferential side, and thus the number of raised portions on the inner circumferential side and the outer circumferential side can be different.

Moreover, the elements in the inner cutter shapes (blade support and cutter blade shapes) described in the above can be indeed taken and freely combined to form an inner cutter.

The invention claimed is:

1. An inner cutter for a rotary shaver comprising:

a metal inner cutter main body;

a plurality of blade supports each having a perpendicular portion raised perpendicular to said metal inner cutter main body, a bent portion extending from said perpendicular portion in a direction opposite to a direction of rotation of said inner cutter to a tip end of the blade support, and a cutter blade formed at said tip end and extending in said direction of rotation of said inner cutter.

2. The inner cutter for a rotary shaver according to claim 1, wherein said cutter blades are provided at the tip ends of said blade supports in a linear form.

3. The inner cutter for a rotary shaver according to claim 1, wherein said bent portion has a linear shape.

4. The inner cutter for a rotary shaver according to claim 1, wherein said bent portion has a circular arc shape.

5. An inner cutter for a rotary shaver comprising:

a metal inner cutter main body;

a plurality of blade supports each having an inclined portion raised from said metal inner cutter main body and inclined in a direction opposite from a direction of rotation of said inner cutter, a circular arc portion extending from said inclined portion to a tip end of the blade support, and a cutter blade formed at said tip end and extending in said direction of rotation of said inner cutter.

* * * * *